United States Patent [19]

Stechmann et al.

[11] 4,270,200

[45] May 26, 1981

[54] TIMED CHIME SYSTEM

[75] Inventors: Helmut Stechmann; Jens Haberer, both of Schwenningen, Fed. Rep. of Germany

[73] Assignee: Kienzle Uhrenfabriken GmbH, Schwenninen, Fed. Rep. of Germany

[21] Appl. No.: 966,189

[22] Filed: Dec. 4, 1978

[30] Foreign Application Priority Data

Dec. 2, 1977 [DE] Fed. Rep. of Germany ..... 2753733

[51] Int. Cl.[3] ..... G04C 21/16

[52] U.S. Cl. ..... 368/252; 368/243; 368/267; 368/250

[58] Field of Search ..... 368/243, 267, 250, 252; 340/384 E, 392; 84/1.01, 1.24

[56] References Cited

U.S. PATENT DOCUMENTS

| | | | |
|---|---|---|---|
| 3,775,967 | 12/1973 | Spadini | 368/252 X |
| 4,040,248 | 8/1977 | Laesser | 368/252 |

FOREIGN PATENT DOCUMENTS 2609871 9/1977 Fed. Rep. of Germany .

*Primary Examiner*—Ulysses Weldon

*Attorney, Agent, or Firm*—Pollock, Vande Sande & Priddy

[57] ABSTRACT

A timed chime system wherein the minute timer of a clock mechanism generates a start chime signal every half hour. The start chime signal is applied to turn on a power switch to apply power to the elements of the chime system and to set system components to begin a chime cycle. In response to the start chime signal, the hour timer of the clock mechanism operates a coder to generate a BCD count signal corresponding to the position of the hour hand of the clock. The BCD count signal is then applied to set a particular hour count in a programmable counter and a chime tone circuit is activated to generate a number of Bim-Bam audio tones. As each Bim-Bam audio tone is generated, the programmable counter is decremented by one and, when the counter is decremented to zero, the chime system is reset. After a particular time delay, the power switch is operated to turn off system power.

10 Claims, 13 Drawing Figures

TIMED CHIME SYSTEM

BACKGROUND OF THE INVENTION

The invention relates to a timed chime apparatus for a clock, and, more particularly, to such an apparatus including electronic means for periodically generating a number of chime tones corresponding to the time of the clock.

A timed chime system utilizing a crystal controlled clock is disclosed in the published German patent applications Nos. 25-56-765 and 26-09-871 which are incorporated herein by reference. In the system of the cited German patent applications, an angular coder is connected to the hour spindle of a clock and the minute spindle of the clock carries a contact arm that moves over stationary contacts to define a minute chime sequence.

In operation, the contact arm of the minute spindle moves to a start chime position to initiate a gong sequence having a maximum of four strokes for the full hour. For this purpose, an electromotor is energized to move a cam shaft and an associated hammer to produce an audible gong for each quarter hour. For each movement of the minute cam shaft there is generated a corresponding electrical pulse and each pulse is counted by a reference circuit.

When the appropriate count of the electrical pulses for the minute gongs is reached, the reference circuit initiates the reading of the angular coder having a BCD code corresponding to the position of the hour hand of the clock. Thereafter, an electromotor is energized to move an hour cam shaft and to thereby produce a series of audible hour gong signals. For each hour gong signal, a corresponding electrical pulse is generated and applied to the reference circuit. The number of such hour gong pulses is compared to the BCD code number of the angular coder and, when the number of hour gong pulses is the same as the BCD code number, the gong activation circuitry is turned off.

The chime apparatus of the cited German patent applications has the disadvantage that it is mechanical in operation and, therefore, is subject to the problems of wear and mechanical failure that are associated with such devices. Furthermore, a great number of sliding contacts are used by the apparatus and these contacts do not generally operate satisfactorily at all times. Also, the design of the electronic circuitry for the system is complicated due to the division of system control between the quarter hour and full hour signals. In addition, the system does not use electronic tones because of technical problems relating to the application of power in electronic tone systems and to the electronic generation of proper tones.

Accordingly, it is an object of the invention to provide a relatively simple and power-efficient electronic system for generating timed audible tones to signal the time of a clock.

Another object of the invention is to provide a means for generating timed audible signals comprising a sequence of tones.

These and other objects of this invention will become apparent from a review of the detailed specification which follows and a consideration of the accompanying drawings in which like reference characters identify identical apparatus.

BRIEF SUMMARY OF THE INVENTION

In order to achieve the objects of the invention, the timed chime apparatus, according to the invention, includes a first pulse generation means for generating a start chime pulse every half hour. The start chime pulse is applied to turn on a power switch to apply power to the apparatus of the invention and to set a trigger circuit.

The trigger circuit operates to enable a timing pulse source and the "power on" condition of the system causes a counter to be set to a BCD count state supplied by an angular coder. The BCD count of the coder corresponds to the position of an hour hand on a clock.

Thereafter, the timing pulse source applies timing pulses to first and second tone control circuits to generate, respectively, a Bim and a Bam audible tone. Each Bim-Bam audible signal corresponds to one hour chime of the clock. As each Bim-Bam audio signal is generated, the second tone control circuit applies a pulse to decrement the counter by one and, when the counter is decremented to zero, the counter operates to reset the trigger circuit.

The reset trigger circuit operates to disable the timing pulse source and applies a power off signal to a time delay circuit. After a particular time delay corresponding to the period of generation of the last Bim-Bam tone, the time delay circuit operates to shut off the power switch to remove power from the apparatus of the invention.

DETAILED DESCRIPTION OF PREFERRED EMBODIMENTS

Figure 1:
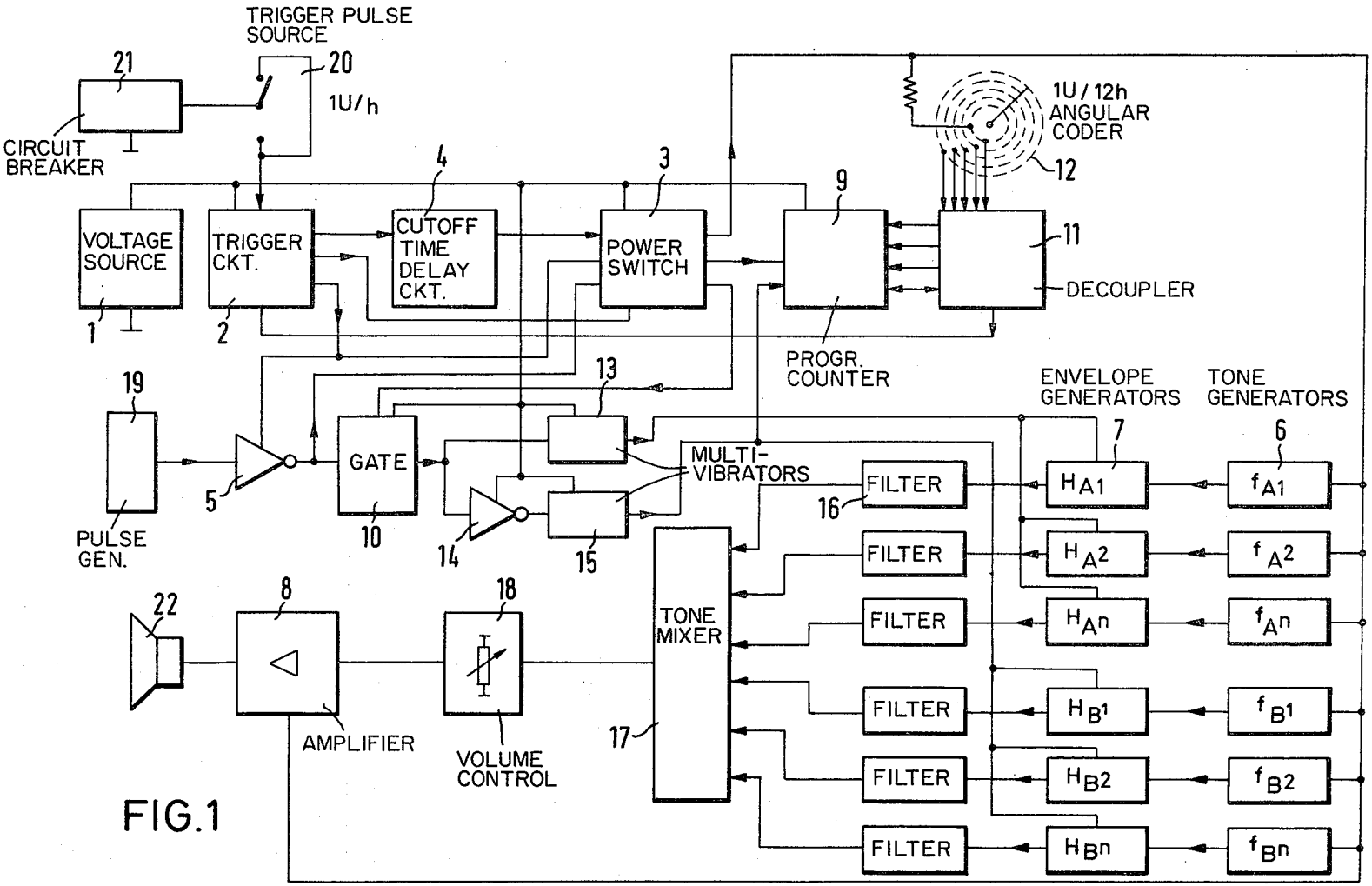
FIG. 1 shows a block diagram of an embodiment of the timed chime system according to the invention.

As shown in FIG. 1, the voltage source 1 is connected to a chimes-triggering circuit 2 and a power switch 3. When the voltage source 1 is connected, the chimes-triggering circuit 2 will switch automatically to the off-position, thereby disconnecting the power switch 3. The outlet of the chimes-triggering circuit 2 is connected to a cut-off-time delay circuit 4, the power switch 3 and a level converter 5.

When the power switch 3 is in the "on" position, its outlets will apply a voltage across electronic frequency generators comprising tone generators 6 and envelope generators 7, and will also energize an amplifier 8 and an angular coder 12. In addition, the applied voltage will enable a programmable counter 9 and a gate circuit 10.

The programmable counter 9 is programmed by an angular coder 12 and an associated decoupling circuit 11.

The output of the gate circuit 10 is connected directly to the input of a first monostable multivibrator 13 and to the input of a second monostable multivibrator 15 by way of an inverter 14. The multivibrator 13 is connected to a first group HAl–HAn of envelope generators 7, and the second multivibrator 15 is connected to a second group HBl–HBn of envelope generators 7. The outlets of all envelope generators 7 are connected by way of filters 16 with a tone-mixing circuit 17. The output of the tone mixer 17 is connected to a volume control 18 that is in turn connected to an audio amplifier 8 and associated speaker 22.

The input of the level converter 5 is driven by periodically occurring pulses of, for example 0.5 cps, that are generated by a pulse generator 19 of a clock. The chimes-triggering circuit 2 is connected to a trigger pulse source 20 that produces a pulse to initiate the generation of a tone or a sequence of tones. The chimes-triggering circuit 2 is also connected to a circuit breaker 21 that can turn off the entire electronic system to prevent the generation of chimes.

Figure 4:
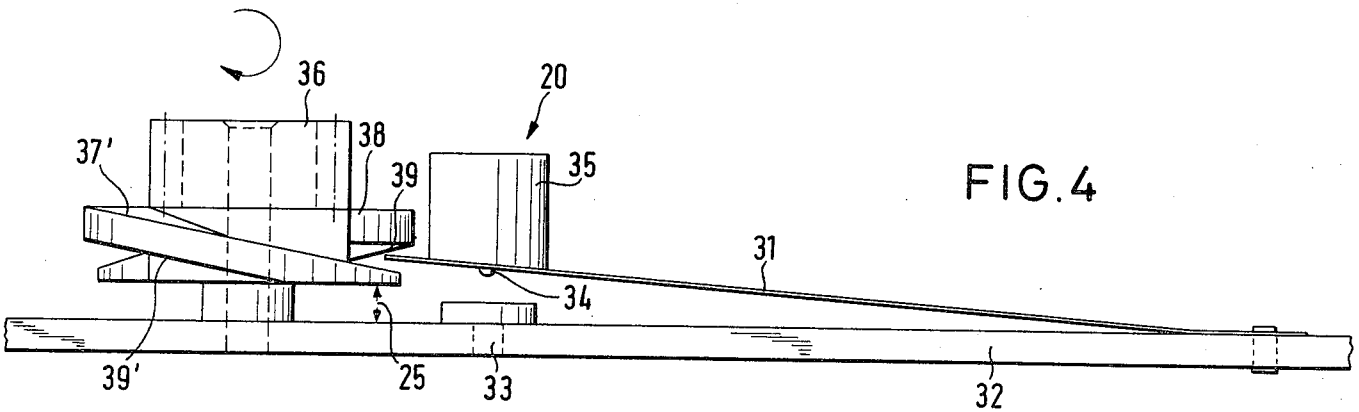
FIG. 4 shows a side view of a mechanical switch embodiment of the trigger pulse source of FIG. 1.

The embodiment illustrated in FIG. 1 is designed to produce one tone or a sequence of tones every half hour. Thus, in accordance with the invention, the trigger pulse source 20 will generate one pulse every thirty minutes. As shown in FIG. 4, this pulse generation can be accomplished by a contact arm 31 that interacts with two accommodating slopes 37, 37' that are positioned on opposite sides of a cam 36 connected to a minute spindle (not shown) of a clock, where the spindle completes one revolution every hour. The angular coder 12 is coded in accordance with a BCD code and is in communication with an hour spindle that completes one turn in twelve hours. It is also feasible to provide a 24-hour coding, with one turn being completed in 24 hours. The tones for the full hours are coded in the angular coder 12 and, for the preferred embodiment of the invention, the half hour tones are included as well.

In operation, the chimes-triggering circuit 2 is set by a pulse from the pulse source 20. The set trigger circuit 2 then applies a signal to enable the level converter 5 and the power switch 3. The first pulse from the pulse source 19 that arrives after the converter 5 is enabled is inverted and passed by the converter 5, and the leading edge of the pulse at the output of the converter 5 is applied to turn on the power switch 3. The turned on power switch 3 applies power to the tone generator 6, envelope generators 7, coder 12 and amplifier 8 and also enables the counter 9 and the gate circuit 10.

After the programmable counter 9 is enabled, a count code from the angular coder 12 is entered into the counter 9 through the decoupler circuit 11. For example, if a sequence of four strokes is required, the counter 9 is programed by way of the coder 12 and the decoupling circuit 11 with the number 4.

Since the gate circuit 10 is now enabled, the trailing edge of the first pulse of the output of the converter 5 is passed by the gate circuit 10 to the monostable multivibrator 13 to activate the multivibrator 13 and to thereby cause the multivibrator 13 to generate a pulse that is applied to charge the condensers of the first group HAl–HAn of the envelope generators and to thereby pass a series of tones. The frequencies produced by the tone generators fAl–fAn will thereafter be caused to fade in an exponential fashion. The filters 16 filter the harmonics from the generated tones and the resultant frequencies are mixed in the tone mixer 17. The mixed frequencies are amplified in the audio amplifier 8 and are emitted by way of a loudspeaker 22. In accordance with the invention, the tone generators fAl–fAn, envelope generators HAl–HAn and associated filters produce a "Bim" sound that decays exponentially due to the discharge of the associated capacitors of the envelope generators HAl–HAn.

In order to produce a total chime, the embodiment of the invention utilizes an additional group of tone generators fBl–fBn, envelope generators HBl–HBn and filters 16 to produce an exponentially decaying "Bam" sound that is generated in a time delayed manner with respect to the Bim sound to provide a chime having a Bim-Bam sound for each "stroke" of the clock. Thus, a second monostable multivibrator 15 is provided to operate the additional group of audio apparatus to produce the Bam component of the chime in the above-described manner.

An inverter 14 is connected to the output of the gate circuit 10 and the input of the multivibrator 15 to invert the activating signal from the gate circuit 10 and to thereby activate the multivibrator 15 in a delayed manner with respect to the multivibrator 13. Of course, it should be appreciated that the trailing edge of the inverted signal from the inverter 14 will activate the multivibrator 15.

Thus, in operation the trailing edge of the first signal at the output of the converter 5 activates the multivibrator 13 and causes a "bim" tone to be generated. Thereafter, the leading edge of the second pulse from the converter 5 activates the multivibrator 15 and the "Bam" tone is generated. The output pulse of the multivibrator 15 is also applied to the counter 9 to reduce the count stored in the counter by one. The Bim tone is then generated on the trailing edge of the second pulse from the converter 5 and the corresponding Bam tone is generated on the leading edge of the 3rd pulse from the converter 5. Of course, the counter 9 is decremented again when the second Bam tone is generated.

It should be appreciated that if it is desired to have only the "Bim" audio signal correspond to a clock stroke, the audio circuitry associated with the "Bam" signal should be disconnected and the output of the multivibrator 13 should be applied to decrement the counter 9 after the generation of each "Bim" signal.

It should be understood that when a chime cycle is initiated, the counter 9 is set by the angular coder 12 to a count state corresponding to the position of the hour hand of the clock. Also, if the apparatus of the invention is operated to generate a Bim-Bam chime for each stroke of the clock, the counter 9 will be decremented by one after each Bam signal is generated and, when a number of chimes corresponding to the initial count state of the counter 9 is produced, the counter 9 will have been decremented to zero.

When the counter 9 is decremented to zero, the decoupling circuit 11 generates a reset signal to reset the chimes-triggering circuit 2. Resetting the chimes-triggering circuit 2 causes the converter 5 to be disabled, thereby blocking the pulses generated by the pulse generator 19. However, at this moment the power switch 3 remains on since the final completed Bam tone is still in its decaying phase. A cut-off time delay circuit 4 is provided to receive the signal from the reset triggering circuit 2 and to apply a corresponding power cut-off signal to the power switch 3 after a time delay sufficient to allow the final tone to be completed. The time delay of the circuit 4 is longer than the decay time of the "Bam" tone, as determined by the condensers in the second group of the envelope generators 7.

The circuit-breaker 21 makes it possible to hold the chimes-triggering circuit 2 in the reset or off state and to thereby cut off the entire chimes system. It is possible to code this circuit breaker 21 in such a manner that the chimes-triggering circuit 2 will be disconnected throughout a certain period of time, for example the chimes system could be held in an inoperative state at night.

Figure 3:
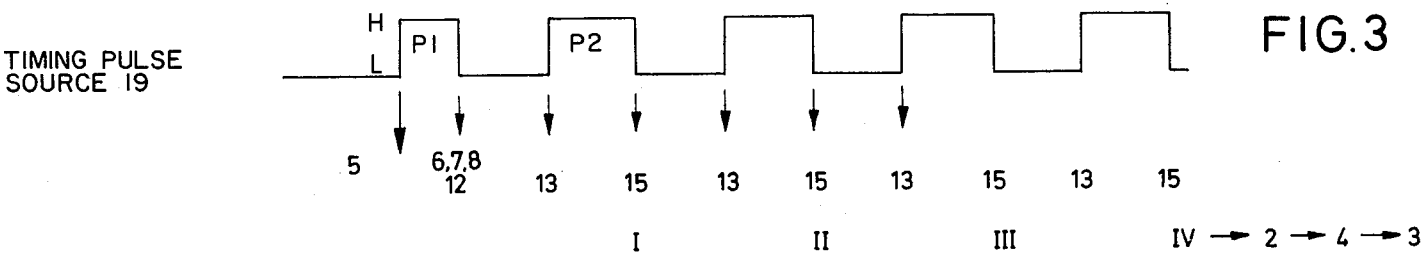
FIG. 3 shows a timing diagram of the operating pulses of the trigger pulse source and the timing pulse source of FIG. 1.

FIG. 3 illustrates a timing diagram of the above-described pulses from the timing pulse source 19 and the trigger pulse source 20. When the pulse source 20 produces a pulse, the trigger circuit 2 is set and the converter 5 and power circuit 3 are thereby enabled. The trailing edge of the first pulse P1 activates the power switch 3 to turn the power switch 3 on and to thereby apply power to the circuits 6, 7, 8 and 12. The leading edge of the next pulse P2 activates the multivibrator 13 and thereby causes the Bim tone to be generated. The trailing edge of the pulse P2 activates the multivibrator 15 to cause the Bam tone to be generated and to decrement the counter 9. This sequence will be repeated until the counting unit 9 has been set to "0" by the pulses of the multivibrator 15. When the counter 9 is decremented to zero, the coupler 11 applies a reset signal to the trigger circuit 2 to reset the trigger circuit 2. After a particular time delay the time delay circuit 4 operates to turn off the power switch 3.

Figure 2:
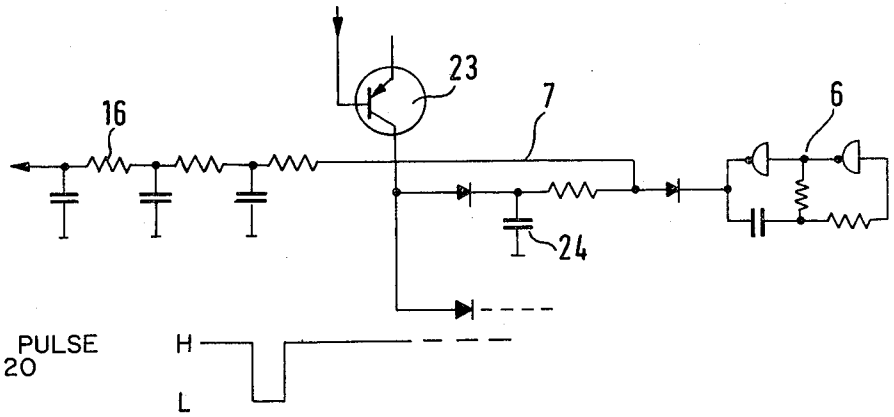
FIG. 2 shows a circuit diagram of the frequency generator of FIG. 1.

FIG. 2 illustrates an example of the design of a frequency generator which consists of a tone generator 6 in the form of an astable multivibrator with a pulse interval ratio of 1:1. The frequency generator is further equipped with an envelope generator 7 which will pass the tone frequency produced by the tone generator 6 to the filters 16 so long as its condenser 24 is charged. The charge of a condenser 24 is applied by means of a control transistor 23 having a base that is connected to the output of one of the multivibrators 13 or 15 respectively. The discharge of the condenser 24 occurs through a resistor in accordance with an exponential function. In this manner, a square-wave is generated with an amplitude that decreases in accordance with an e-function. This exponentially decaying square-wave passes through filters that attenuate the associated harmonics. Thus, an almost-ideal sine wave signal appears at the output of the filter 16, with an amplitude that decreases in accordance with an e-function.

The signals that appear at the output ports of the several filters 16 are combined in the tone-mixing circuit 17 in a manner known to the art.

The size of the condensers 24 is correlated to the frequencies produced by the tone generators 6, and is guided by the principle that a lower frequency requires a correspondingly greater capacitance.

The frequencies produced in the several single frequency tone generators must also have a certain correlation in order to make it possible to simulate in an ideal manner the tone effects, for example of a sound rod. These frequencies can, for example, have a ratio of approximately 1:6.27:17.6:34.4:56.8:85.0 and so on. Each of the single frequency generators can be a divider stage of a frequency divider connected in series with an oscillator.

The circuit design can be simplified due to the fact that the pulse produced by the pulse source 20 need not have a specific shape or duration since the pulse merely serves to set the chimes-triggering circuit 2. In addition, means other than a switch contact could be employed to generate the reset pulse for the triggering circuit 2. For example, a frequency divider could be employed to generate such reset pulses every 15 or 30 minutes. Also, it should be understood that the mechanical angular coder 12 could be replaced by a suitable electronic coder adapted to generate BCD coded outputs in response to timed input signals from, for example, a digital clock.

Figure 5:
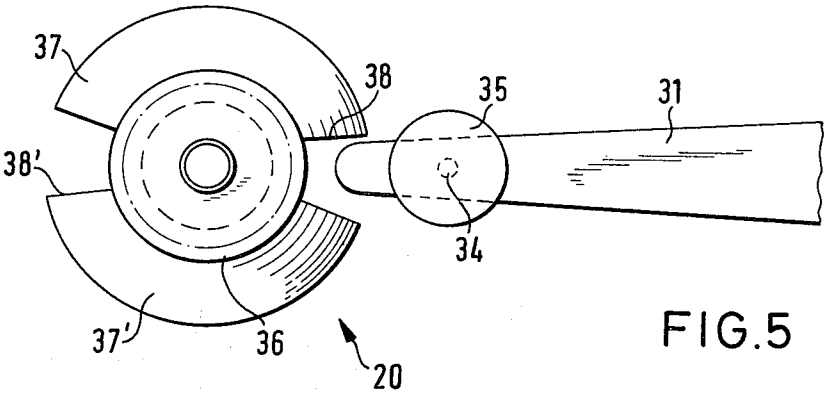
FIG. 5 shows a top view of the mechanical switch embodiment of FIG. 4.

A practical example of the pulse source will now be explained with reference to FIGS. 4 and 5. As shown in FIG. 4, a contact spring 31 is riveted at one end to an insulating plate 32, upon which is arranged a stationary contact 33. The contact spring 31 carries a weight 35 and a contact 34 that is opposed to the stationary contact 33. A cam 36 may be placed to engage a minute spindle (not illustrated) of a clock or, alternatively, it is possible to use an arrangement wherein the cam 36 forms one piece with a pinion that engages a clockwork wheel rotating at one revolution per hour.

The cam 36 carries two spirally-shaped accommodating slopes 37, 37' that are positioned opposite halves of the cam. Each slope has a declining shoulder 38, 38' positioned at the end thereof. When the cam 36 is turning in the direction shown by the arrow, the end of the contact spring 31 is lifted gradually by the slope 37' and placed under tension. When the end of the spring 31 passes over the shoulder 38', the end of the spring 31 drops until the contacts 33 and 34 are touching. The weight 35 ensures that proper contact is made and, in addition, the weight 35 damps the vibrations of the spring 31.

After having dropped to the contact position, the spring 31 is then lifted again, in this case by the spirally shaped accommodating slope 37. Thereafter, the spring 31 drops into the contact position when the end of the spring 31 passes over the shoulder 38. Since the cam 36 completes one turn per hour, a contact will be made in the above described manner every half-hour. Of course, if only one slope is provided, contact will be made once an hour. If, on the other hand four slopes are used, a contact will occur every fifteen minutes.

Since the cam 36 will turn counterclockwise when the hands of the clock are adjusted counterclockwise, it is necessary to prevent the shoulders 38 or 38' from striking the end of the contact spring 31. For this purpose, there may be provided a segmentally shaped slot 39, 39' below each accommodating slope 37, 37'. Each segmentally shaped slot 39, 39' may run level with the rest position of the end of the contact spring 31. At least the end of each slot 39, 39' may extend substantially parallel to the associated slope 37 or 37' respectively. Therefore, it at least becomes possible to set back the hands of the clock up to 20 minutes, even if the contact spring 31 has just dropped off a shoulder 38, 38'. Since in the case of the slot design illustrated in FIGS. 4 and 5, the contact 34 approaches the contact 33 when the clock hands are being turned back, it is possible to design the electronic circuit of the system to activate the chimes when the contacts 33 and 34 are closed during such a counterclockwise resetting operation to provide a warning that further counterclockwise movement is not permitted. However, it is also possible to narrow the end of each slot 39, 39' to form a gap 25 and to extend each gap up to the lowest point of the associated slope. Thus, when the clock hands are turned back beyond the 20-minute maximum, the spring end will be guided within the gap 25 so that the cam can be turned back further without interference.

It should be appreciated that the weight 35 generally controls the contact period of the spring 31 since the weight 35 serves to increase angular momentum and thus extends the duration of the vibration of the spring.

Figure 7:
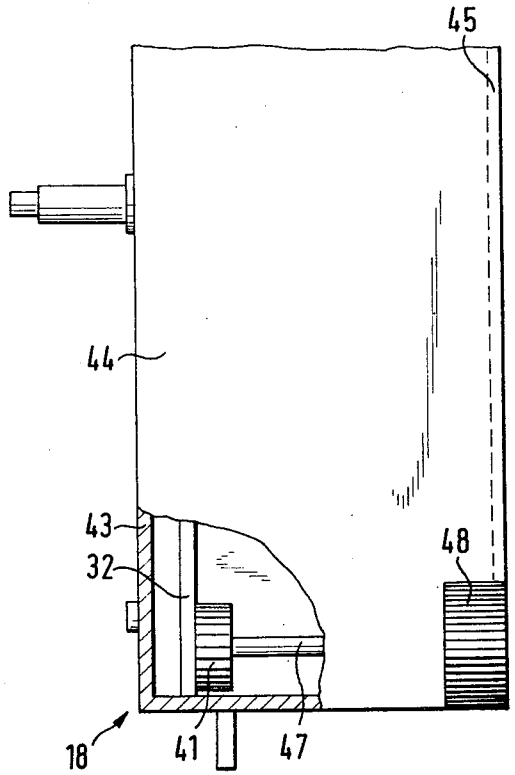
FIG. 7 shows a side view, partially in cross-section of the casing of FIG. 6.
Figure 6:
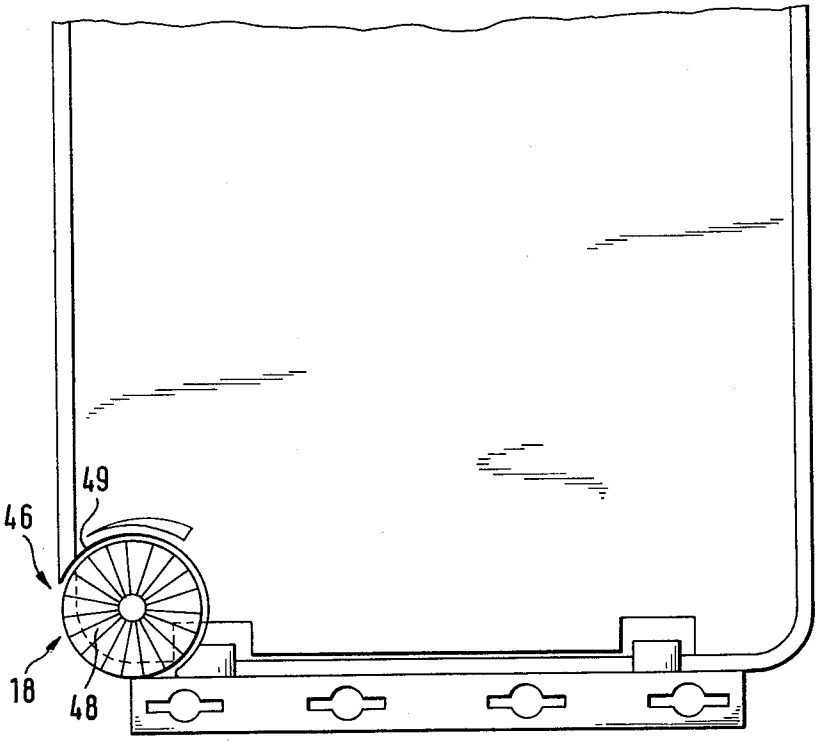
FIG. 6 shows a rear view of the casing of an embodiment of the invention.

The operation of the volume control may be understood with reference to FIGS. 6 and 7. The volume control includes a potentiometer 41 that is located at a circuit board 32 that carries the electronic components for the chime system of the invention. The circuit board 32 is connected to the front side 43 of a casing in a manner known to the art. The casing 44 is generally U-shaped when viewed in cross-section and its rear side is closed off by a cover 45.

FIG. 7 shows the potentiometer 41 positioned at the outer side of the circuit board 32, and FIG. 6 shows that the potentiometer is located at one corner of the circuit board 32 within a corner section 46 of the casing 44. A regulating shaft 47 of the potentiometer 41 extends to the rear side of the casing and has an attached regulating knob 48 that is positioned in a recess 49. The recess 49 matches the contour of the regulating knob 48 and opens toward the corner section 46. FIGS. 6 and 7 show how the contour of the regulating knob 48 matches the contours of the casing 44 on the sides and in the rear, and demonstrate that the regulating knob 48 can be operated from below or from the rear. The knurling provided at the sides and at the top of the knob 48 facilitates the adjustment of the potentiometer 41.

Figure 8:
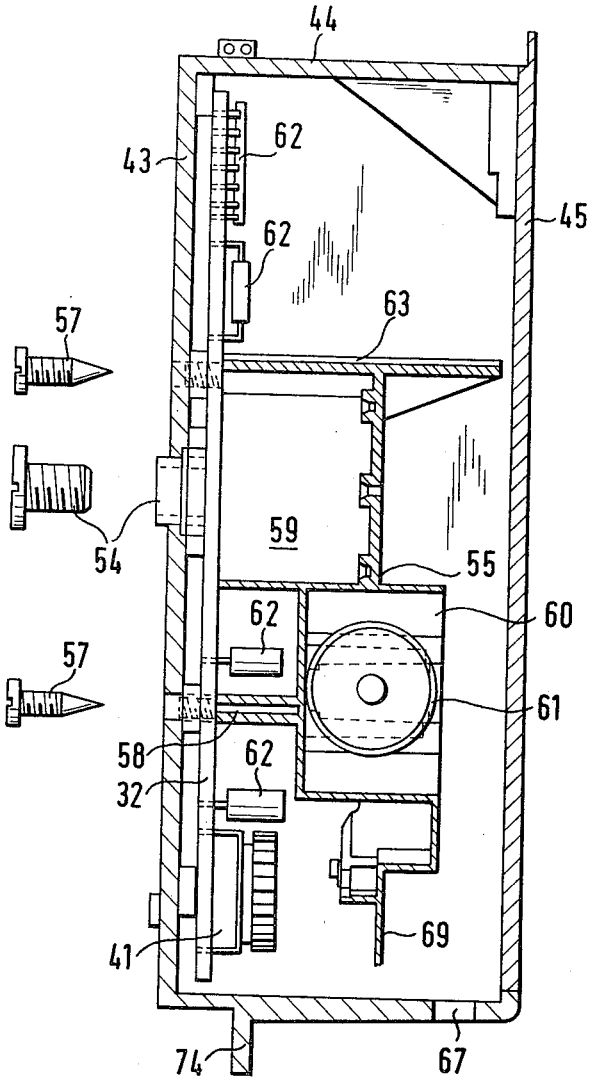
FIG. 8 shows a plan view of an embodiment of the invention.

FIG. 8 shows a plan view of the chime system of the invention including an outer pot-shaped casing 44 that is closed off in the rear by a cover 45. The front side of the casing 44 forms a clock support 43 that carries a central fastening device 54 through which the spindles of the clock hands extend.

Inside the casing 44 there is arranged a clockwork housing 44 that accommodate the clock mechanism and the clock batteries. Between this clockwork housing 55 and the support 43 is located the circuit board 32 that carries the electronic components of the electronic chime system. Bolts 57 may be inserted through the front side of the support 43 to engage threaded bores 58 at the clockwork housing 55, and to thereby fasten the clockwork housing 55 to the support 43 and clamp the circuit board 32 between the support 43 and the clockwork housing 55.

The assembled electronic, crystal-controlled clock mechanism is inserted into an indentation 59 of the clockwork housing 55 which opens toward the front. The battery 61 is inserted into another indentation 60 that is open toward the rear. The indentation 60 is positioned toward the rear so that between the front wall of the indentation 60 and the circuit board 32 an open area may be formed to accommodate the electronic components 62 of the chime system. FIG. 8 shows how the electronic components 62 of the chime system are arranged on the circuit board 32 in areas outside the area taken up by the clock mechanism.

Figure 9:
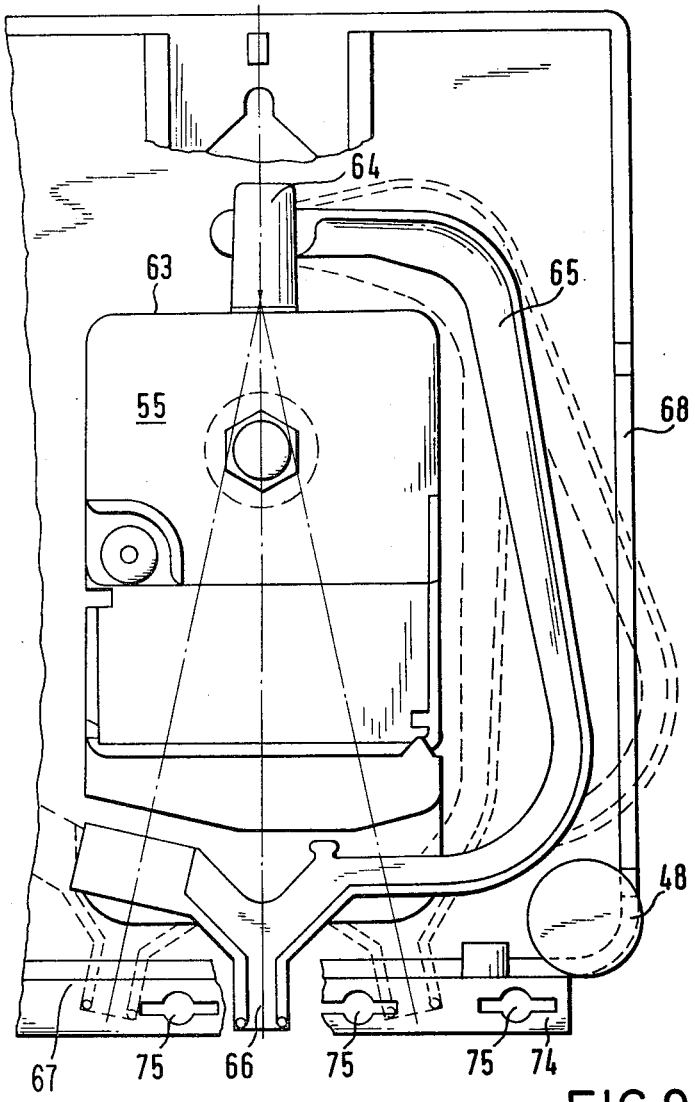
FIG. 9 shows a rear view of an embodiment of the invention utilizing a pendulum in operative association with a clock mechanism.

FIG. 9 shows a pivot bearing 64 that is arranged at the top 63 of the clockwork housing 55. The pivot bearing 64 supports the knife-edge of a pendulum arm 65 that surrounds the clockwork housing 55 in a U-shape. At the lower end of the pendulum arm 65 there is provided a device 66 for suspending the pendulum. The bottom part of the housing has a slot 67 through which the pendulum will protrude. A slot 68 is provided in the side of the housing to provide sufficient space for the swinging of the pendulum arm 65.

The lower end of the pendulum arm 65 carries a permanent magnet (not illustrated) that swings across a coil. The coil is arranged at a circuit board that carries the electronic components of a separate pendulum drive so that the pendulum will swing independently of the clockwork as a dummy pendulum. The circuit board carrying the coil is located at the bottom of the clockwork housing 55 at a point 69.

Figure 10:
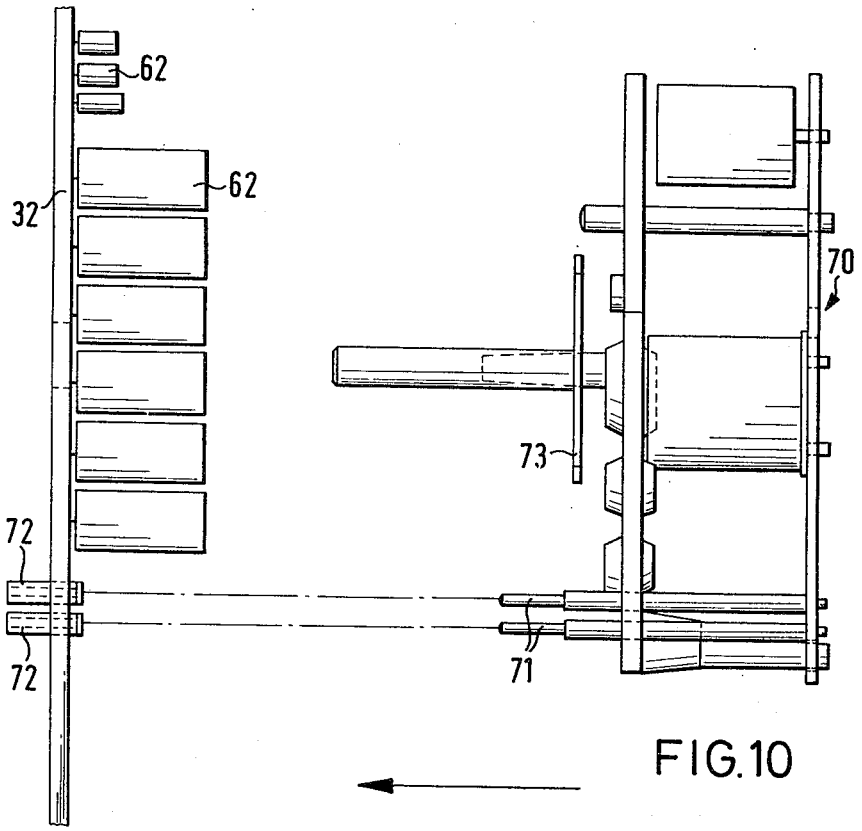
FIG. 10 shows a side view of the assembled clock mechanism and circuit board of an embodiment of the invention.

In order to allow the proper positioning of the clockwork 70 of FIG. 10 relative to the circuit board 32, there are arranged at the clockwork 70 two connectors 71 that are inserted into two plugs 72, located on the circuit board 32. The hour wheel 73 of the clockwork carries at its front side a coder 12 having resilient contact arms positioned at the circuit board and pressing against it. The coding of the disk 12 at the hour wheel 73 controls the sequence of strokes of the electronic chime system.

Figure 11:
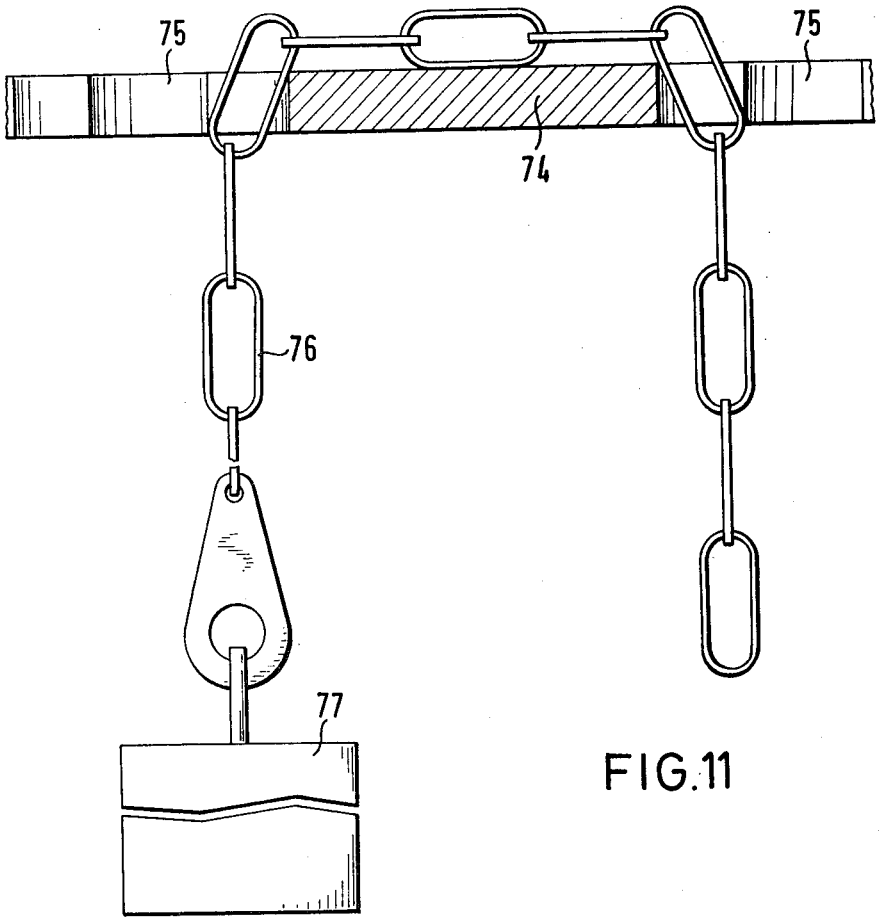
FIG. 11 shows a cross-sectional view of a strip of the casing of FIG. 9 with an attached weight and chain.

As shown in FIGS. 8, 9 and 11, a strip 74 is located at the bottom of the casing 44. The strip 74 has at least two, and preferably four keyhole-shaped recesses 75, in each case with one pair serving to carry a decorative chain 76 that is provided at one end with a weight 77.

Figure 12:
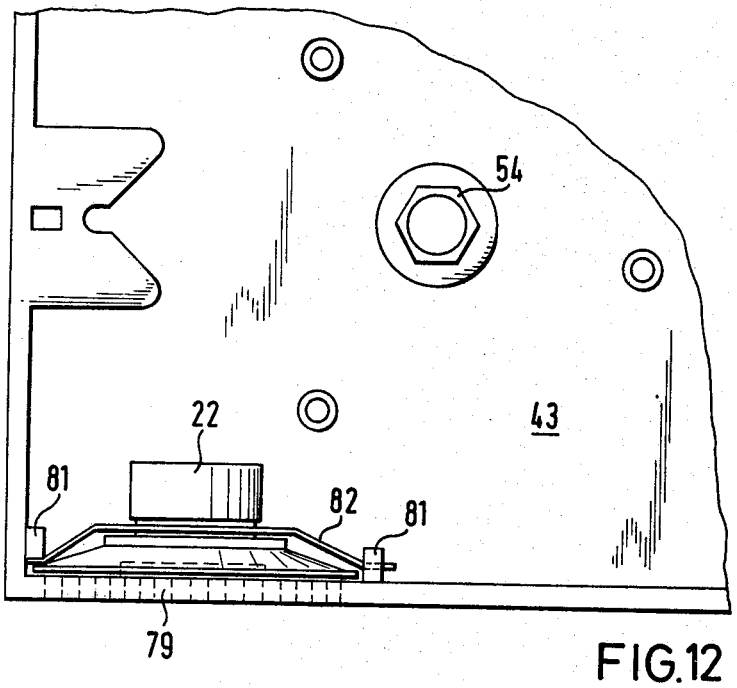
FIG. 12 shows a cut away rear view of a loudspeaker in an embodiment of the invention.
Figure 13:
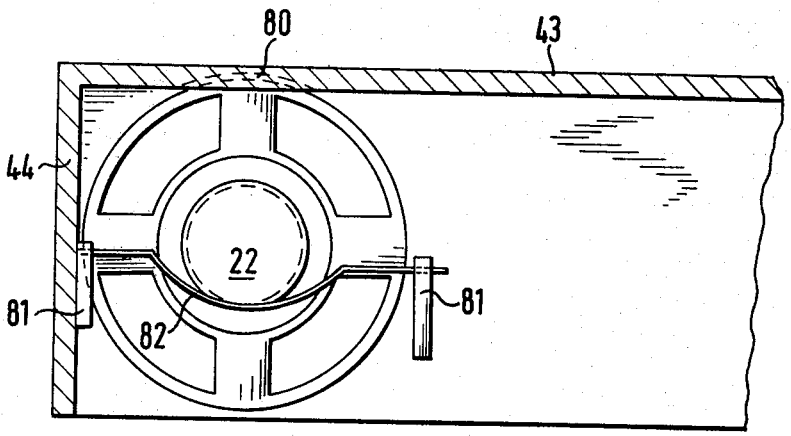
FIG. 13 shows a cross-sectional top view of the loudspeaker of FIG. 12.

As shown in FIGS. 12 and 13, the loudspeaker 22 is affixed to a side wall of the casing 44, adjacent tone-outlets 79 that are arranged within the side wall. A slot 80 is arranged at the inner front side section of the casing, to engage the front rim of the loudspeaker 22. On two sides of the loudspeaker there are arranged hanger hooks 81 that are engaged by a retaining spring 82 that surrounds and holds the loudspeaker 22 at the side facing away from the slot 80.

It should be appreciated that an electrical circuit may be easily constructed to perform the functions outlined in the block diagram of FIG. 1. For example, a commercially available flip-flop integrated circuit could be used to perform the function of the trigger circuit 2. Likewise, the power switch 3 could include a power transistor connected in operative association with a control flip-flop and the converter 5 and gate 10 could utilize commercially available NAND and AND gates to perform their respective functions.

In addition, as will be apparent to those skilled in the electrical arts, the cutoff delay circuit 4 may include a commercially available delay line, and the counter circuit 9 and monostable multivibrators 13 and 15 may include integrated circuits that are readily available and well understood by those skilled in the art.

Moreover, it has been determined experimentally that the multivibrators 13 and 15 may be adjusted to operate with output pulse widths that are approximately three times greater than the time constant that is defined by the impedance of the charging circuits and total capacitances of the associated groups of envelope generators 7. Also, it has been determined that signals at the output ports of the envelope generators may, typically, have a pulse-interval ratio in the range of 40:60 to 60:40.

The invention may be embodied in other specific forms without departing from its spirit or essential characteristics. The present embodiments are, therefore, to be considered in all respects as illustrative and not restrictive, the scope of the invention being indicated by the claims rather than by the foregoing description, and all changes which come within the meaning and range of the equivalents of the claims are therefore intended to be embraced therein.

What is claimed is:

1. A timed chime apparatus for transmitting at least one audio signal corresponding to a time condition of a clock, comprising:

trigger means responsive to a periodic set trigger signal to generate a corresponding chime initiation signal and responsive to a reset signal to generate a block signal, coder means coupled to said clock for generating a count signal corresponding to the hour registration of said clock, decoupler means coupled to said coder means for generating a count condition corresponding to said count signal and for generating said reset signal in response to a zero count condition, counter means coupled to said decoupler means for registering said count condition from said decoupler means and adapted to be decremented to reduce the count in said counter means to said zero count condition thereby to cause said decoupler means to generate said reset signal, timing pulse means for generating a plurality of control timing pulses in response to said chime initiation signal, said timing pulse means being operative to decrement said counter means upon occurrence of each control timing pulse and being responsive to said block signal to stop the generation of said control timing pulses, electronic frequency generator means responsive to each of said control timing pulses to generate a corresponding audio chime signal, power switch means responsive to said chime initiation signal for energizing said frequency generator means, and delay means for receiving said block signal and responsive thereto for operating said power switch means to de-energize said frequency generator means after a particular time delay.

2. The apparatus of claim 1 wherein said frequency generator means includes tone generator means for generating at least two component signals of different frequency in response to each of said control timing pulses;

means for filtering the harmonics from said at least two component signals; and means for mixing said at least two filtered component signals and amplifying the resultant mixed signal to produce said audio chime signal, said means for mixing and amplifying including a volume control for controlling the level of amplification.

3. The apparatus of claim 1 wherein said frequency generator means includes first component generating means for generating at least two first subcomponent signals of differing frequency in response to a first edge of a control timing pulse, first filtering means for filtering the harmonics from said at least two first subcomponent signals, second component generating means for generating at least two second subcomponent signals of different frequency in response to a corresponding second edge of a control timing pulse, second filtering means for filtering the harmonics from said at least two second subcomponent signals, mixer means for mixing said at least two filtered first subcomponent signals and amplifying the resultant mixed signal to produce a first component of said audio chime signal, said mixer means having means for mixing said at least two filtered second subcomponent signals and amplifying the resultant mixed signal to produce a second component of said audio chime signal, said second component being delayed in time with respect to the corresponding first component.

4. The apparatus of claim 3 wherein said first component generating means includes a first monostable multivibrator means responsive to the trailing edge of a particular control timing pulse to initiate the generation of said two first subcomponent signals, said second component generating means including a second monostable multivibrator means responsive to the leading edge of the control timing pulse immediately following said particular control timing pulse to initiate the generation of said two second subcomponent signals, and means coupling said second monostable multivibrator means connecting the second to said counter means to decrement said counter means by one for each generation of an audio chime signal.

5. The apparatus of claim 1 wherein said tone generator means includes single frequency generators having frequency ratios of substantially 1:6.27:17.6:34.4:58:8:85:0.

6. The apparatus of claim 5 wherein each of said single frequency generators includes an astable multivibrator connected in series with an envelope curve generator, the envelope curve generator having means for receiving the signal from the single frequency generator and generating a corresponding exponentially decaying signal in response to a control timing pulse.

7. The apparatus of claim 6 wherein each of said envelope curve generators includes a capacitor that is charged in response to a control timing pulse and that discharges exponentially, the discharge of said capacitor defining the signal intensity of the output signal of the envelope curve generator.

8. The apparatus of claim 1 wherein said timing pulse means includes timing pulse source means for continuously generating timing pulses at 0.5 cps, and converter means for blocking said timing pulses in response to said block signal and inverting said timing pulses to generate corresponding control timing pulses in response to said chime initiation signal.

9. The apparatus of claim 1 further comprising contact means for applying said periodic set trigger signal to said trigger means, said contact means including contact spring means for making and breaking connection with a stationary contact to generate said set trigger signal, and cam means rotating at a fixed rate and having at least one slope means and an associated shoulder, said slope means being engaged with an extending surface of said contact spring means to define at least one trigger signal for every rotation of said cam means.

10. The apparatus of claim 1 wherein said electronic frequency generator means comprises a plurality of single frequency generators, each of said single frequency generators being a divider stage of a frequency divider connected in series with an oscillator.

* * * * *